US007530308B2

(12) United States Patent
Lundin et al.

(10) Patent No.: US 7,530,308 B2
(45) Date of Patent: May 12, 2009

(54) DEVICE FOR CLEANING THE CYLINDERS OF A PRINTING MACHINE

(75) Inventors: Kjell E. Lundin, Zwingenberg (DE); Rune G. Vestman, Zwingenberg (DE)

(73) Assignee: Baldwin Oxy-Dry GmbH, Egelsbach (DE)

( * ) Notice: Subject to any disclaimer, the term of this patent is extended or adjusted under 35 U.S.C. 154(b) by 274 days.

(21) Appl. No.: 11/457,479

(22) Filed: Jul. 14, 2006

(65) Prior Publication Data

US 2007/0012210 A1 Jan. 18, 2007

(30) Foreign Application Priority Data

Jul. 14, 2005 (EP) ..... 05015308

(51) Int. Cl.
*B41F 35/00* (2006.01)

(52) U.S. Cl. ..... 101/425; 101/424

(58) Field of Classification Search ..... 101/425, 101/424

See application file for complete search history.

(56) References Cited

U.S. PATENT DOCUMENTS 3,187,670 A 6/1965 Jennings et al.
3,658,003 A * 4/1972 Johnson ..... 101/483
3,976,007 A * 8/1976 Junghans et al. ..... 101/425
4,015,307 A * 4/1977 Kossak ..... 15/256.52
4,254,709 A * 3/1981 Arnolds ..... 101/425
4,841,862 A * 6/1989 Seefried ..... 101/425
5,010,819 A * 4/1991 Uribe et al. ..... 101/425
6,029,575 A 2/2000 Bischer
6,729,236 B2 * 5/2004 Knabe et al. ..... 101/423

FOREIGN PATENT DOCUMENTS

DE 4010957 10/1991
DE 19601070 7/1997
DE 10230790 1/2004

* cited by examiner

*Primary Examiner*—Anthony H. Nguyen
(74) *Attorney, Agent, or Firm*—Volpe and Koenig, P.C.

(57) ABSTRACT

A device for cleaning cylinders of a printing machine is provided, with the device being provided with a driven washing roller 2 to contact a cylinder 1 to be cleaned. A doctor blade 4 at least temporarily engages the surface of the rotating washing roller 2. A collection trough 6 is provided for the dirt scraped off the rotating washing roller 2 by a doctor blade 4. The doctor blade 4 is mounted in the collection trough 6. The collection trough 6 is movably mounted in reference to the washing roller 2 such that the doctor blade 4 can contact the washing roller 2 or can be moved away from it, when necessary, by a respective movement of the collection trough 6.

10 Claims, 5 Drawing Sheets

DEVICE FOR CLEANING THE CYLINDERS OF A PRINTING MACHINE

BACKGROUND

The invention relates to a device for cleaning the cylinders of a printing machine according to the preamble of claim 1. Here, this device comprises a driven washing roller, which can contact a cylinder to be cleaned. The dirt, which the washing cylinder has removed from the cylinder to be cleaned, is scraped off with a doctor blade, which at least temporarily engages the surface of the rotating washing roller. The doctor blade is mounted to a collecting trough, in which the scraped off dirt is collected and guided away.

Cleaning devices of this type are used for removing deposits and contaminants on cylinders of printing machines, which particularly develop by the intensive contact with the materials to be printed. When paper is printed, primarily paper dust and ink adheres to the cylinders of the printing machine.

In EP-A-1 106 354 an example for a known cleaning device is described. The washing roller, embodied as a brush roller and rotated by the motor of the device, is made to contact a cylinder, which in particular can be an offset-blanket cylinder, a counter-pressure cylinder, a plate or form cylinder, or a cooling roller, color roller, or wet roller of a printing machine. Simultaneously, the cleaning liquids are applied on the washing roller, so that the contaminants adhering to the cylinder are moistened and lifted off the cylinder using the rotating washing roller. The dirt accepted by the washing roller is scraped off by a doctor blade, which sits in several doctor blade holders in a clamped manner. They are inserted into a holding profile serving as a frame of the cleaning device and are fastened there. Below the doctor blade, a collection trough is provided.

Usually, the rotary direction of the brush roller is selected such that its surface travels a path as short as possible between the surface of the cylinder to be cleaned and the doctor blade. Furthermore, the brush roller is scraped off at the doctor blade in a commonly known fashion by elastically bending the individual bristles at the doctor blade and subsequently elastically reerecting the bristles, causing the dirt particles not only to be scraped off the doctor blade but also to be slung off the bristles during the reerection. For this reason, the rotary direction of the brush roller is commonly selected such that the direction that the dirt particles are slung off faces away from the cylinder to be cleaned.

Due to the fact that the contaminants accepted by the washing roller are provided with a strong adhesion force, in particular caused by the ink contained therein, i.e. they are sticky, in such a known cleaning device, some dirt always remains stuck to the holder of the doctor blade, causing dirt to build up with increasing time of operation. Such a dirt build-up can be avoided in that the doctor blade is directly mounted to the collection trough rather than to a separate carrier. An example for such a cleaning device is known from DE-A-197-02-082.

Directly scraping off dirt, removed from the cylinder surface to be cleaned by the brush roller, is not always optimal, though. Dirt particles are not the only matter slung off the brush roller but also the cleaning liquid accepted by the brush roller. During a most effective use of the cleaning liquid for cleaning cylinders in a printing machine it can be advantageous for the brush roller to be without contact to the doctor blade for a certain amount of time. Accordingly, the cleaning liquid remains at the surface of the brush roller and then after one rotation acts again on the surface of the cylinder to be cleaned. The amount of cleaning liquid used is considerably lower in a cleaning cycle without a doctor blade.

This is particularly important in heat-set printing machines, in which the freshly printed material enters a dryer. Such a dryer operates with heat, and the commonly used cleaning liquids contain a high content of volatile hydrocarbons. Particularly heat-set printing machines generally require for the cleaning of the cylinder surface to occur during production. Here, the material being printed, running through the printing machine, accepts the cleaning liquid and subsequently transports it into the dryer. The volatile hydrocarbons evaporate in the dryer, and additionally they are heated, so that there is a constant danger for the hydrocarbon concentration in the dryer to rise above a limit prescribed for safety reasons. Due to the fact that particularly in heat-set printing machines simultaneously materials of high value are to be printed, attention must be paid to the cleaning of the cylinder surface, during which waste paper is unavoidable, to be performed as quickly as possible.

However, these two requirements contradict each other: for the purpose of a high safety against an excess concentration of volatile hydrocarbons in the dryer it is necessary to use as little cleaning liquid as possible. However, in contrast thereto the requirement to keep the cleaning cycle as short as possible demands the use of relatively much cleaning liquid, because the time is too short for the contaminants on the surface of the cylinder to be cleaned to be moistened. The goal is therefore to achieve maximum efficiency in the use of cleaning liquids.

This includes for the doctor blade not to be kept in permanent contact with the surface of the washing roller but to interrupt this contact temporarily. Then, the cleaning liquid remains on the surface of the washing roller for a longer period of time and thus it has more time to soften the contaminants on the surface of the cylinder to be cleaned. Then it is necessary less frequently to add new cleaning liquid; the consumption of cleaning liquid drops accordingly while a comparable cleaning result is maintained.

One example for a cleaning device with a washing roller contacting the doctor blade, when necessary, and separable therefrom is found in U.S. Pat. No. 5,010,819. Here, the doctor blades are brought into the area of the washing roller by way of individually movable holders and, if necessary, made to contact the surface of the washing roller.

SUMMARY

The present invention is based on the objective of improving the cleaning device of the type mentioned at the outset with regard to its handling.

This objective is attained by a device having the features of claim 1. Preferred embodiments and further developments are described in claims 2 through 9.

The device according to the invention is distinguished from the devices previously known in particularly in that the collection trough is movably mounted in reference to the washing roller such that the doctor blade mounted at the collection trough can be made to contact the washing roller by a respective movement of the collection trough, if necessary, or be removed from the engagement of the surface of the washing roller. This way, the doctor blade can be taken off the engagement with the surface of the washing roller in the interest of a most efficient use of cleaning liquid so that the cleaning liquid is not immediately slung off the washing roller during the cleaning process. However, no movable holders for doctor blades are necessary, to form a "bridge" between the doctor blade and the frame of the device, a housing wall, or a holding profile, which can lead to a dirt build-up, which ultimately also affects the contacting and separating mechanics at the holders of the doctor blades. Instead, the doctor blade moves together with the collection trough, at which it is fastened, into contacting the surface of the washing roller and out of said engagement. Therefore, in any case the dirt scraped off reaches only the collection trough; no dirt build-up can develop.

The front wall of the collection trough can be embodied as a doctor blade holder; however, it may also be advantageous for the doctor blade holder to be arranged inside the collection trough, because particularly in brush rollers being scraped off the dirt is not only slung off but partially also scraped off the bristles at the front side of the doctor blade, so that it runs down the front side of the doctor blade. Therefore it is also advantageous for the holder of the doctor blade to be provided with gaps or perforations below the doctor blade so that the dirt running down the front side of the doctor blade through the gaps or perforations can enter the collection trough and/or that part of the collection trough primarily collecting the dirt.

The doctor blade is preferably embodied as a squeegee bar and is located in a holder adjusted to the doctor blade located in or at the collection trough. In this holder, the squeegee bar can be inserted in particular in a clamping manner and is therefore easily exchangeable. Using conventional adjustment screws the squeegee bar can be adjusted in its height inside the holder in order to compensate for wear, for example.

The holder for the squeegee bar can be arranged inside the collection trough. Here, it is advantageous for the holder to have two side walls, which are provided with penetrations in their lower section so that the dirt running down the front side of the doctor blade can reach the other side of the holder.

Particular advantages results when the collection trough, which is movable according to the invention, is preferably embodied in a removable manner and is pivotable around a rotary axis like a lever. Because then, the collection trough including the doctor blade arranged thereon or therein can easily be removed from the device in order to be cleaned and, if necessary, for the doctor bar to be replaced or turned to bring a new edge of the squeegee bar into the effective position.

The pivotal arrangement of the collection trough in the type of a rocker is preferably embodied such that the collection trough is supported in a holder, which is pivotally mounted at a rotary axis in the manner of a rocker having two lever arms, with one lever arm being spring-loaded and the other lever arm having an actuator operating against said spring force, in particular a hydraulic or pneumatic piston-cylinder unit. Mounting the collection trough at said pivotal holder occurs preferably by way of detachable connection elements, for example a catch mechanism. Hereby, the pivotal function and the removability of the collection trough can be provided in a robust and easy manner as well as securely operable.

The doctor blade, known per se, can be provided as a profile element with a hexagonal cross-section. In connection with clamping fasteners, the doctor blade can be repositioned by a simple rotation about its longitudinal axis in order to replace a worn doctor blade with a new one.

BRIEF DESCRIPTION OF THE DRAWINGS

In the following, an exemplary embodiment of the invention is described in greater detail and explained using the attached drawing. Shown are.

DETAILED DESCRIPTION OF THE PREFERRED EMBODIMENTS

Figure 1:
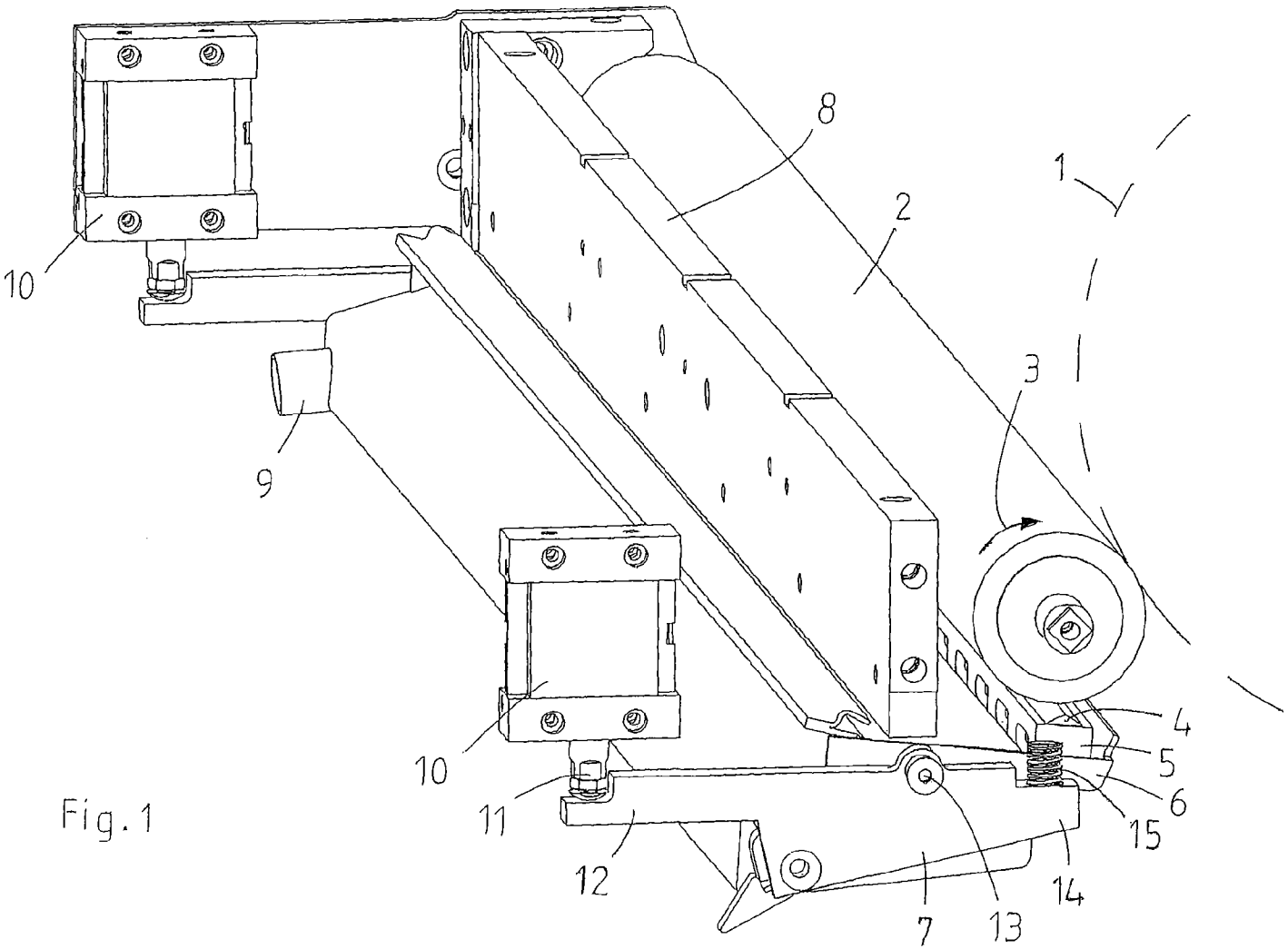
FIG. 1 a perspective view of an embodiment of a cleaning device according to the invention (schematically)

In FIG. 1, the surface of a cylinder 1 to be cleaned is indicated by a dashed line. A washing roller 2 embodied as a brush roller contacts the surface of the cylinder 1 to be cleaned and moves in the rotary direction 3 first over the surface of the cylinder 1 to be cleaned, collects dirt there, and transports it further to a doctor blade 4, which sits in an holder 5 in a clamped manner. The holder 5 is arranged in a collection trough 6, which itself is mounted to a carrier 7. A housing of the cleaning device shown is only indicated here, namely by way of a separating wall 8.

At the rear of the collection trough 6, a drain 9 is provided for the scraped off dirt, which is mixed with the cleaning liquid.

At the housing 17 (not shown in FIG. 1) of the device, pneumatic elements 10 are mounted, each of which operating a piston-cylinder unit 11 that acts upon a second lever arm 12 of the carrier 7, pivotable around a pivot axis 13, while a first lever arm 14 is pre-stressed by a spring 15.

Figure 2:
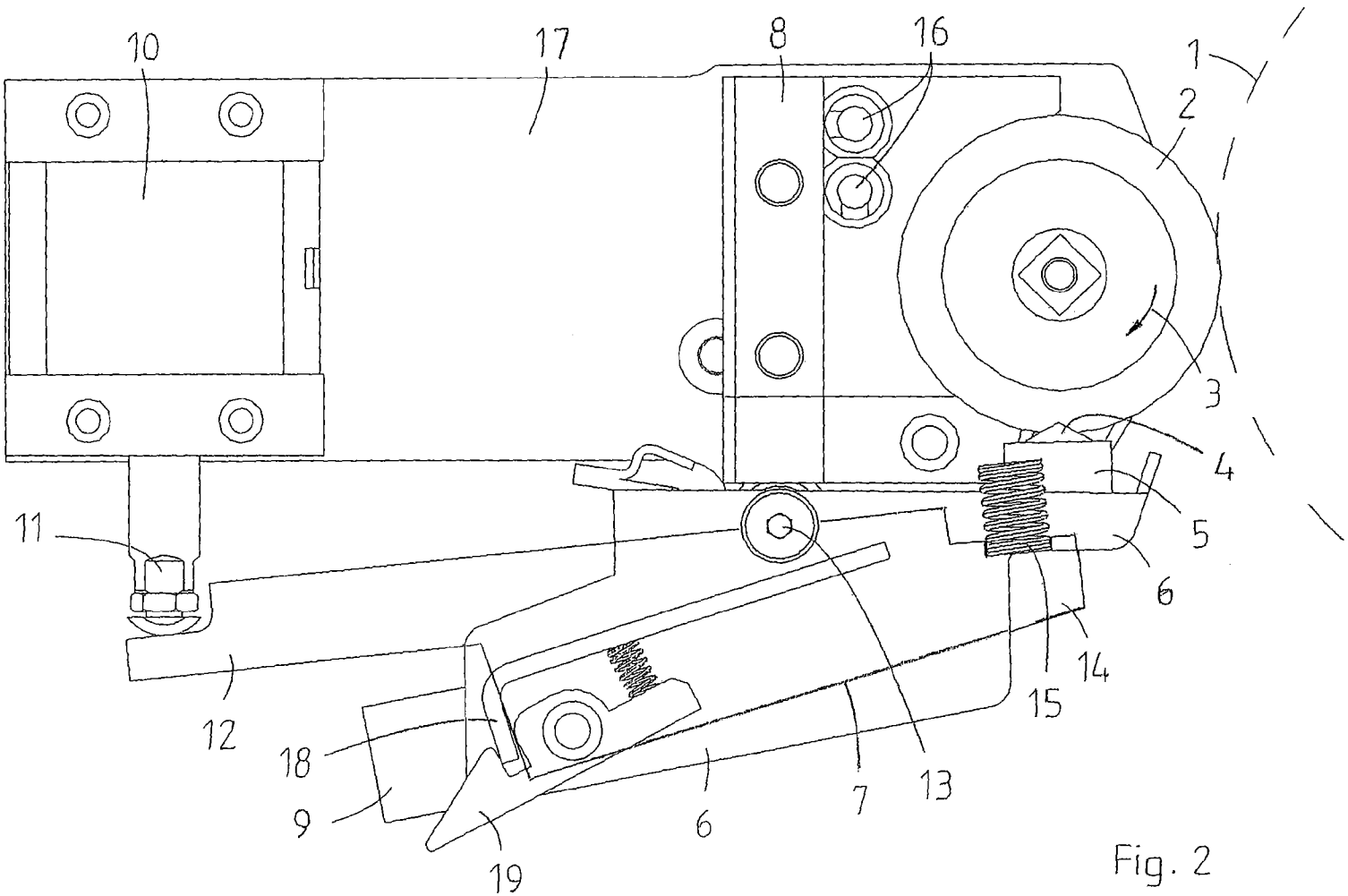
FIGS. 2 to 4: a side view of the device according to FIG. 1, in different operating states.
Figure 3:
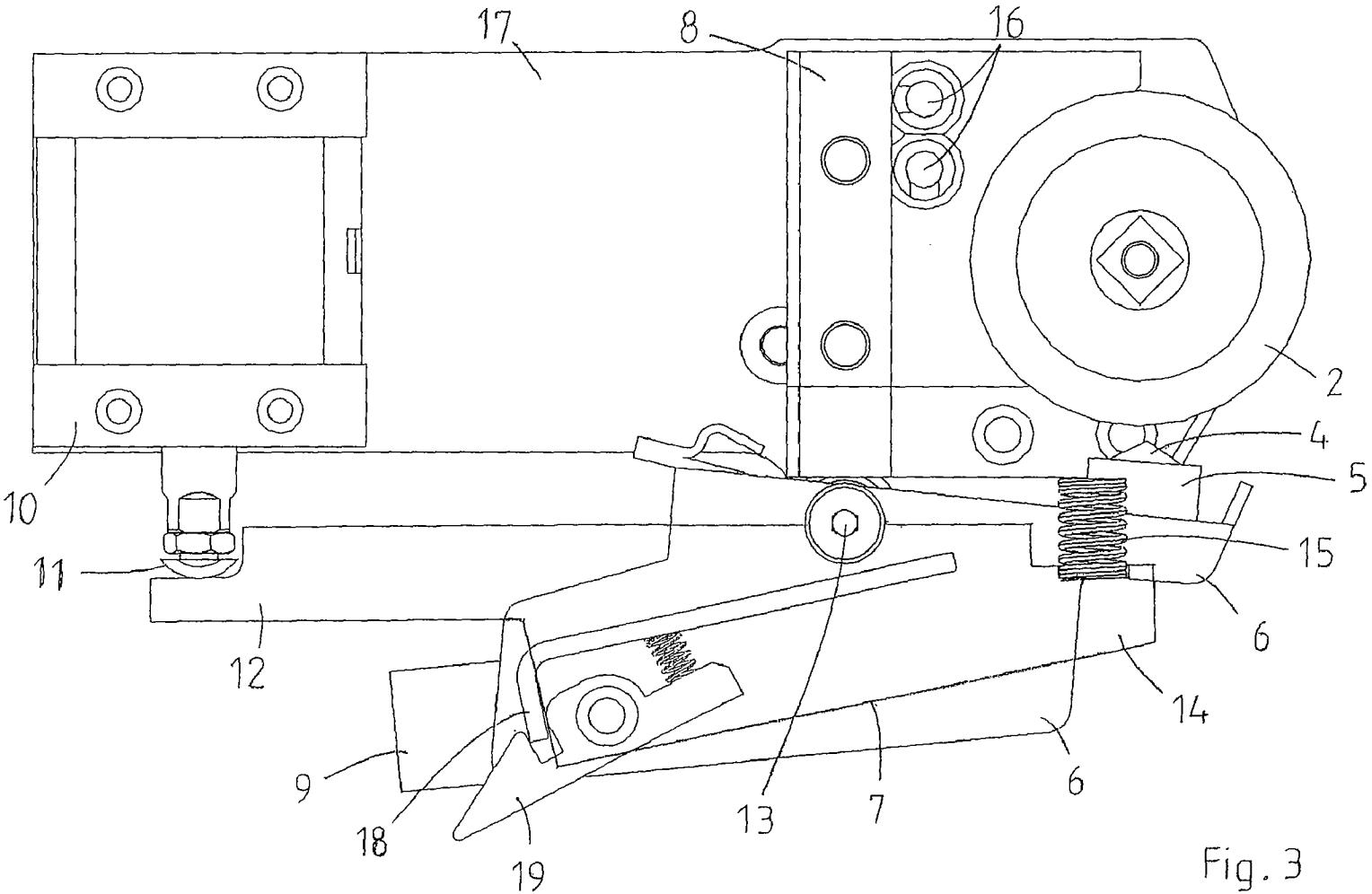
Figure 4:
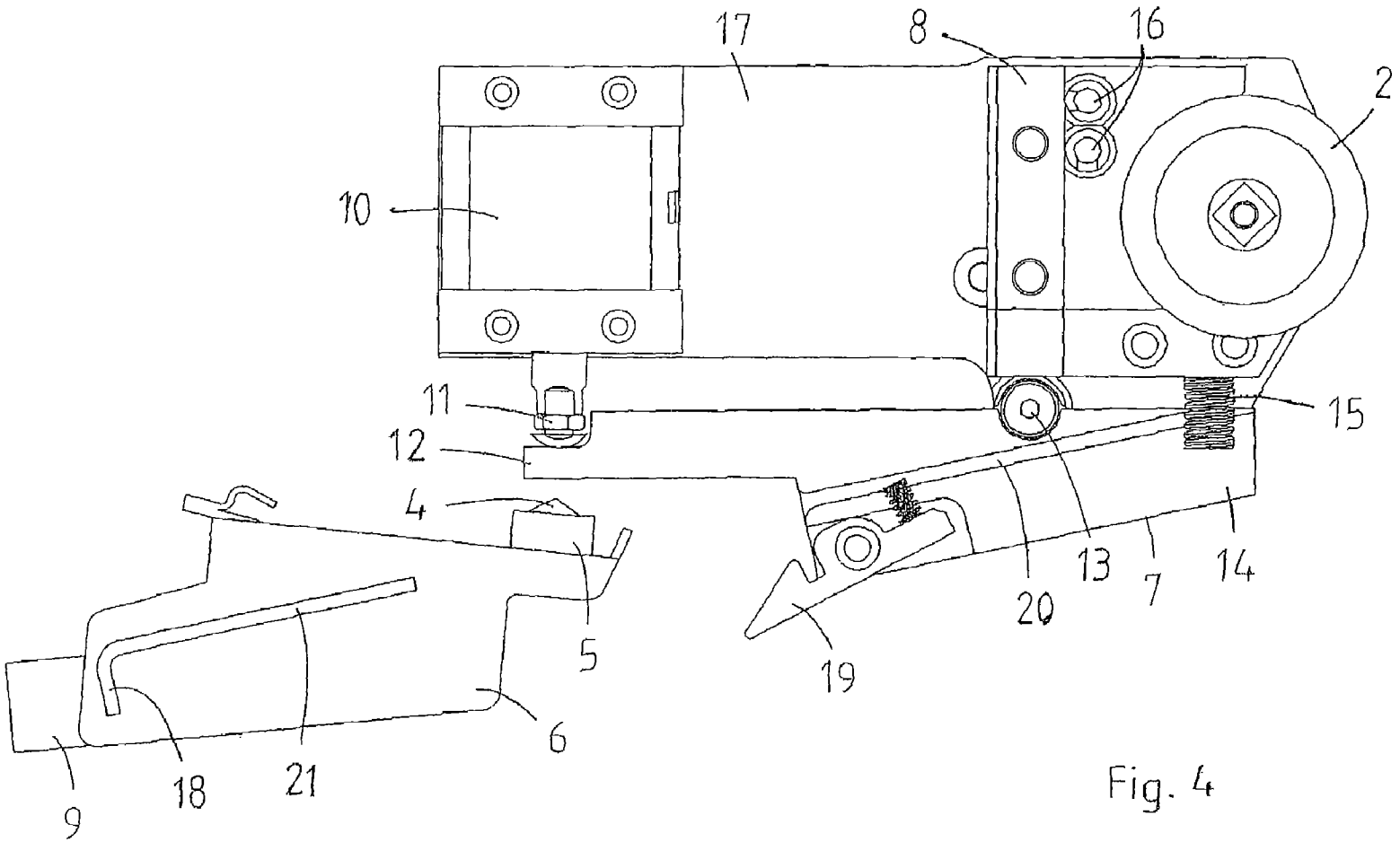

FIGS. 2 through 4 show a lateral view of the device shown in FIG. 1 in different operating states thereof, in which identical parts are marked with the same reference characters, so that reference can be made to the description of FIG. 1. Here, in addition to the parts known from FIG. 1, spray pipes 16 for the cleaning liquid as well as a housing 17 are shown.

In FIG. 2, the operating state is shown with the doctor blade 4 engaging the surface of the washing roller 2. The piston-cylinder unit 11 is extended and presses against the second lever arm 12 so that the carrier 7 with the collection trough 6 mounted thereto can be pivoted around a pivotal axis 13 against the force of the spring 15. The collection trough 6 pivoted in this manner leads to the holder 5, arranged in the collection trough 6, and the doctor blade 4, located in the holder 5, such that the doctor blade 4 contacts the washing roller 2 and is therefore activated. A catch 18 is arranged in the collection trough 6, which is engaged from the rear by a spring-loaded bar 19 mounted at the carrier 7.

FIG. 3 shows the operating state of the device, in which the doctor blade 4 is separated from the washing roller 2. By relaxing the piston-cylinder unit 11, the second lever arm 12 does no longer counteracts the force of the spring 15 so that the carrier 7 and also the collection trough 6 can be rotated around the pivotal axis 13 such that the doctor blade 4 located in the holder of the collection trough 6 has been moved downward and out of the engagement with the washing roller 2.

In FIG. 4, an easy detachment of the collection trough 6 including the doctor blade 4, located in the holder 5, is shown. By loosening the bar 19, against the spring force acting upon it, the catch 18 is released so that the collection trough 6 can be taken out of the carrier 7. The seat of the collection trough 6 in the carrier 7 is ensured, on the one hand, by a guide 20 in the carrier 7 and, on the other hand, by a bar 21, which continues in the catch 18, arranged at the collection trough 6 and displaceable in said guide. After cleaning the collection trough 6 and/or exchanging the doctor blade 4, the collection trough 6 is simply pushed back into the guide 20, with the bar 19 automatically snapping behind the catch 18.

Figure 5:
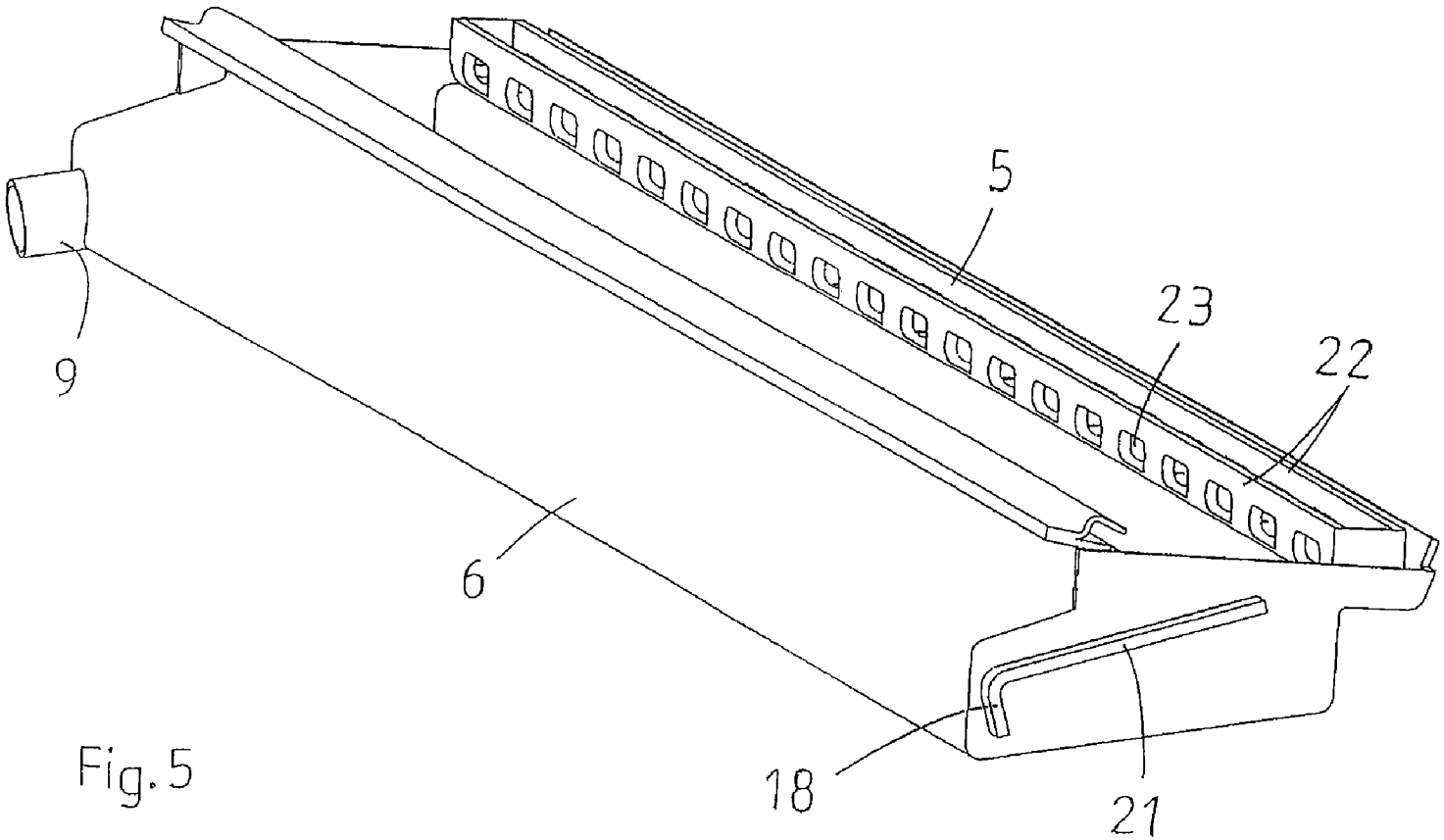
FIG. 5 separately, the collection trough of the device according to FIG. 1.

FIG. 5 finally shows the collection trough 6, removed from the device, in a perspective representation. Here, in particular, clearly discernible is the bar 21 with the catch 18 formed thereat as well as the holder 5 for the doctor blade 4 (not shown here). Using this representation it is clear that the holder 5 is arranged inside the collection trough 6 and that it is a part thereof so that no dirt build-up is to be feared at any fasteners of doctor blades, perhaps even kept mobile. The contacting and separating of the doctor blade occurs, as described above, by pivoting the entire collection trough 6. The holder 5 has two lateral walls 22, which are provided in their lower section with penetrations 23. Dirt running down the front side of the doctor blade, can reach the rear part of the collection trough 6, through said penetrations 23, and thus to the drain 9.

The invention claimed is:

1. A device for cleaning the cylinders of a printing machine, comprising a driven rotating washing roller (2) arranged for movement into contact with a cylinder (1) to be cleaned, a doctor blade (5) arranged to at least temporarily contact a surface of the washing roller (2), and a collecting trough (6) positioned to receive dirt scraped off the rotating washing roller (2) by the doctor blade (4), the doctor blade (4) is mounted to the collecting trough (6), the collecting trough (6) is movably mounted in reference to the washing roller (2) to move the doctor blade (4) from a first position, in contact with the surface of the washing roller (2) by way of a corresponding movement of the collecting trough (6), to a second position, in which the doctor blade is not in contact with the washing roller.

2. A device according to claim 1, wherein the collecting trough (6) is removably mounted.

3. A device according to one of claim 1, wherein the doctor blade (4) comprises a squeegee bar and is positioned in a holder (5), adjusted to the squeegee bar, located in or on the collecting trough (6).

4. A device according to claim 3, wherein the holder (5) has two side walls (22), which are provided in lower sections thereof with penetrations (23).

5. A device according to claim 4, wherein the holder (5) is provided with adjustment elements for adjusting a depth of the squeegee bar.

6. A device according to claim 1, wherein the collecting trough (6) is arranged pivotably for movement around a pivot axis (13).

7. A device according to claim 6, wherein the collecting trough (6) is located on a carrier (7), which is pivotably mounted for movement around the pivot axis (13) and includes a first lever arm (14) and a second lever arm (12), the first lever arm (14) is spring-loaded via a spring, and the second lever arm (12) is provided with an actuator acting against a spring force of the spring.

8. A device according to claim 7, further comprising detachable connection elements (18, 19, 20, 21), wherein the collecting trough (6) is mounted to the carrier (7) by the detachable connection elements (18, 19, 20, 21).

9. A device according to claim 8, wherein the detachable connection elements comprise a catch mechanism (18, 19).

10. A device according to claim 7, wherein the actuator comprises a hydraulic or pneumatic piston-cylinder unit (11).

* * * * *